US008229738B2

(12) United States Patent
Crebouw

(10) Patent No.: US 8,229,738 B2
(45) Date of Patent: Jul. 24, 2012

(54) METHOD FOR DIFFERENTIATED DIGITAL VOICE AND MUSIC PROCESSING, NOISE FILTERING, CREATION OF SPECIAL EFFECTS AND DEVICE FOR CARRYING OUT SAID METHOD

(76) Inventor: Jean-Luc Crebouw, Les Ulis (FR)

( * ) Notice: Subject to any disclaimer, the term of this patent is extended or adjusted under 35 U.S.C. 154(b) by 1185 days.

(21) Appl. No.: 10/544,189

(22) PCT Filed: Jan. 27, 2004

(86) PCT No.: PCT/FR2004/000184

§ 371 (c)(1),
(2), (4) Date: Aug. 1, 2005

(87) PCT Pub. No.: WO2004/070705

PCT Pub. Date: Aug. 19, 2004

(65) Prior Publication Data

US 2006/0130637 A1 Jun. 22, 2006

(30) Foreign Application Priority Data

Jan. 30, 2003 (FR) ..... 03 01081

(51) Int. Cl.
*G10L 11/04* (2006.01)

(52) U.S. Cl. ..... 704/207

(58) Field of Classification Search ..... 704/207
See application file for complete search history.

(56) References Cited

U.S. PATENT DOCUMENTS 4,201,105 A * 5/1980 Alles ..... 84/606
4,357,852 A * 11/1982 Suenaga ..... 84/681
5,054,072 A * 10/1991 McAulay et al. ..... 704/207
5,684,262 A 11/1997 Nakamura et al.
5,744,742 A * 4/1998 Lindemann et al. ..... 84/623
6,031,173 A * 2/2000 Ikeda et al. ..... 84/605
6,240,386 B1 * 5/2001 Thyssen et al. ..... 704/220
6,658,197 B1 * 12/2003 Shimura ..... 386/221
2002/0184009 A1 12/2002 Heikkinen
2008/0147384 A1 * 6/2008 Su et al. ..... 704/207

FOREIGN PATENT DOCUMENTS

WO WO 01/59766 8/2001

OTHER PUBLICATIONS

Moulines E et al: "Non-parametric techniques for pitch-scale and time-scale modification of speech" Speech Communication, Elsevier Science Publishers, Amsterdam, NL, vol. 16, No. 2, Feb. 1, 1995, pp. 175-205, XP004024959 ISSN: 0167-6393 abstract section 2.3.2 Pitch scale modification.

* cited by examiner

*Primary Examiner* — Jakieda Jackson
(74) *Attorney, Agent, or Firm* — Young & Thompson

(57) ABSTRACT

A method for differentiated digital voice and music processing, noise filtering and the creation of special effects. The method can be used to make the most of digital audio technologies, by performing a pre-encoding audio signal analysis, assuming that any sound signal during one frame interval is the sum of sines having a fixed amplitude and a frequency which is linearly modulated as a function of time, the sum being temporally modulated by the signal envelope and the noise being added to the signal prior to the sum.

21 Claims, 5 Drawing Sheets

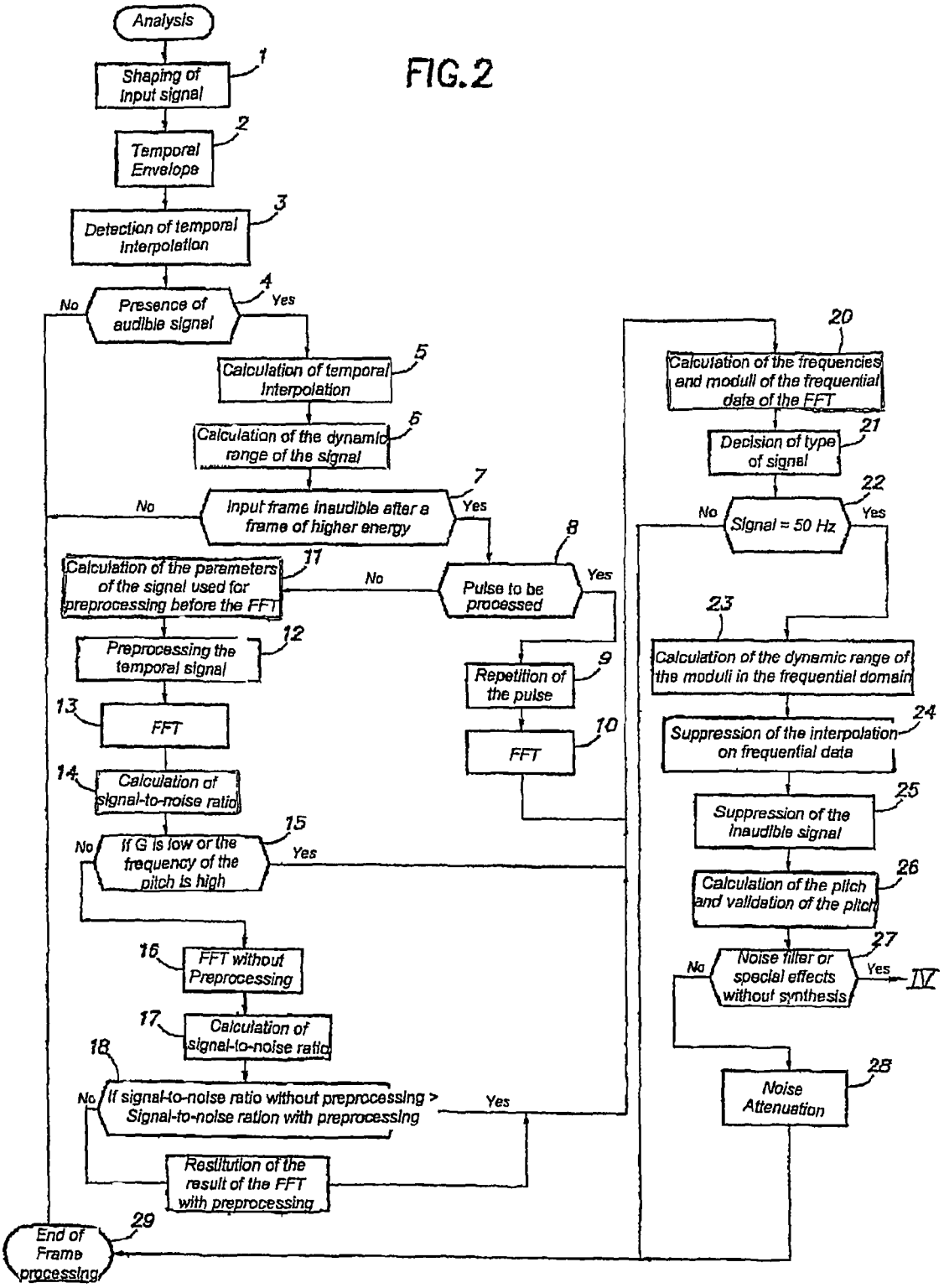
FIG.2
Analysis
1
Shaping of input signal
2
Temporal Envelope
3
Detection of temporal interpolation
4
Presence of audible signal
No
Yes
5
Calculation of temporal interpolation
6
Calculation of the dynamic range of the signal
7
Input frame inaudible after a frame of higher energy
No
Yes
8
Pulse to be processed
No
Yes
9
Repetition of the pulse
10
FFT
11
Calculation of the parameters of the signal used for preprocessing before the FFT
12
Preprocessing the temporal signal
13
FFT
14
Calculation of signal-to-noise ratio
15
If G is low or the frequency of the pitch is high
No
Yes
16
FFT without Preprocessing
17
Calculation of signal-to-noise ratio
18
If signal-to-noise ratio without preprocessing > Signal-to-noise ration with preprocessing
No
Yes
Restitution of the result of the FFT with preprocessing
29
End of Frame processing
20
Calculation of the frequencies and moduli of the frequential data of the FFT
21
Decision of type of signal
22
Signal = 50 Hz
No
Yes
23
Calculation of the dynamic range of the moduli in the frequential domain
24
Suppression of the interpolation on frequential data
25
Suppression of the inaudible signal
26
Calculation of the pitch and validation of the pitch
27
Noise filter or special effects without synthesis
No
Yes
IV
28
Noise Attenuation

METHOD FOR DIFFERENTIATED DIGITAL VOICE AND MUSIC PROCESSING, NOISE FILTERING, CREATION OF SPECIAL EFFECTS AND DEVICE FOR CARRYING OUT SAID METHOD

BACKGROUND OF THE INVENTION

1. Field of the Invention

The present invention relates to differentiated digital voice and music processing, noise filtering, creation of special effects as well as a device for carrying out said method.

2. Description of the Related Art

More particularly its purpose is to transform the voice in a realistic or original manner and, more generally, to process the voice, music and ambient noise in real time and to record the results obtained on a data processing medium.

It applies in particular, but not exclusively, to the general public and to sound professionals who wish to transform the voice for games applications, process the voice and music differently, create special effects, reduce ambient noise, and record the results obtained in compressed digital form.

In a general manner, it is known that the vocal signal comprises a mixture of very complex transient signals (consonants) and of quasi-periodic parts of signal (harmonic sounds). The consonants can be small explosions: P, B, T, D, K, GU; soft diffused consonants: F, V, J, Z or hard ones CH, S; with regard to the harmonic sounds, their spectrum varies with the type of vowel and with the speaker.

The ratios of intensity between the consonants and the vowels change according to whether it is a conversational voice, a spoken voice of the lecturing type, a strong shouted voice or a sung voice. The strong voice and the sung voice favour the vowel sounds to the detriment of the consonants.

The vowel signal simultaneously transmits two types of messages: a semantic message conveyed by the speech, a verbal expression verbal of thought, and an aesthetic message perceptible through the aesthetic qualities of the voice (timbre, intonation, speed, etc.).

The semantic content of speech, the medium of good intelligibility, is practically independent of the qualities of the voice; it is conveyed by the temporal acoustic forms; a whispered voice consists only of flowing sounds; an "intimate" or close voice consists of a mixture of harmonic sounds in the low frequencies and of flowing sounds in the high frequencies; the voice of a lecturer or of a singer has a rich and intense vocal spectrum.

With regard to musical instruments, these are characterized by their tessitura, i.e. the frequency range of all the notes that they can emit. However, very few instruments have a "harmonic sound", that is to say an intense fundamental accompanied by harmonics whose intensity decreases with rank.

On the other hand, the musical tessitura and the spectral content are not directly related; certain instruments have maxima of energy included in the tessitura; others exhibit a well defined maximal energy zone, situated at the high limit of the tessitura and beyond; others, finally, have widely spread maxima of energy which extend greatly beyond the high limit of the tessitura.

Moreover, it is known that the analogue processing of these complex signals, for example their amplification, causes an unavoidable degradation which increases as said processing progresses and does so in an irreversible manner.

The originality of digital technologies is to introduce the greatest possible determinism (i.e. an a priori knowledge) at the level of the processed signals in such a way as to carry out special processing operations which will be in the form of calculations.

Thus, if the signal representing a sound, originally in its natural form of vibrations, is converted into a digital signal provided with the previously mentioned properties, this signal will be processed without undergoing degradation such as background noise, distortion and limitation of pass band; furthermore, it can be processed in order to create special effects such as the transformation of the voice, the suppression of the ambient noise, the modification of the breathing of the voice and differentiation between voice and music.

Audio-digital technology of course comprises the following three main stages:

- the conversion of the analogue signal into a digital signal,
- the desired processing, transposed into equations to be solved,
- the conversion of the digital signal into an analogue signal since the last link in the chain generates acoustic vibrations.

In a general manner, it is known that sound processing devices, referred to by the term vocoder, comprise the following four functions:

- analysis,
- coding,
- decoding,
- synthesis.

The patent US 2002/184009 (HEIKKINEN Ari) of 5$^{th}$ Dec. 2002 proposes a method for the suppression of the variation of pitch by individually displacing the pulses of the pitch of the analysis frame in order to obtain a fixed pitch.

The patent WO 01/59766A (COMSAT) of 16$^{th}$ Aug. 2001 proposes a technique for the reduction of noise using linear prediction.

The U.S. Pat. No. 5,684,262 A describes a method which consists of multiplying the original voice by a tonality in order to obtain a frequential shift and to thus obtain a voice which is lower or higher.

Moreover, data compression methods are used essentially for digital storage (for the purpose of reducing the bit volume) and for transmission (for the purpose of reducing the necessary data rate). These methods include a processing prior to the storage or to the transmission (coding) and a processing on retrieval (decoding).

From among the data compression methods, those using perceptual methods with losses of information are the most used and in particular the MPEG Audio method.

This method is based on the masking effect of human hearing, i.e. the disappearance of weak sounds in the presence of strong sounds, equivalent to a shifting of the hearing threshold caused by the strongest sound and depending on the frequency and amplitude difference between the two sounds.

Thus, the number of bits per sample is defined as a function of masking effect, given that the weak sounds and the quantification noise are inaudible. In order to draw the most advantage from this masking effect, the audio spectrum is divided into a certain number of sub-bands, thus making it possible to specify the masking level in each of the sub-bands and to carry out a bit allocation for each of them.

The MPEG audio method thus consists in:

- digitizing in 16 bits with sampling at 48 kHz,
- deriving the masking curve between 20 Hz and 20 kHz,
- dividing the signal into 32 sub-bands,
- evaluating the maximum amplitude reached in each sub-band and during 24 ms,
- evaluating the amplitude of just inaudible quantification noise, allocating the number of bits for the coding, generating the number of bits in the sub-band, packaging this data in a data frame which is repeated every 24 ms.

This technique consists in transmitting a bit rate that is variable according to the instantaneous composition of the sound.

However, this method is more adapted to the processing of music and not of the vocal signal; it does not make it possible to detect the presence of voice or of music, to separate the vocal or musical signal and noise, to modify the voice in real time for synthesizing a different but realistic voice, to synthesize breathing (noise) in order to create special effects, to code a vocal signal comprising a single voice or to reduce the ambient noise.

SUMMARY OF THE INVENTION

The purpose of the invention is therefore more particularly to eliminate these drawbacks.

For this purpose it proposes a method making it possible of take more advantage of digital audio technologies by carrying out, prior to the coding, an analysis of the audio signal by considering that any sound signal in the interval of a frame is the sum of sines of fixed amplitude and whose frequency is modulated linearly as a function of time, this sum being modulated temporally by the envelope of the signal, the noise being added to this signal prior to said sum.

According to the invention, this method of transformation of the voice, of music and of ambient noise, essentially comprises:

during the analysis phase:

the calculation of the envelope of the signal, the calculation of the pitch (period of the fundamental of the voice signal) and of its variation, the application to the temporal signal of the inverse variation of the pitch by linear interpolation, the Fast Fourier Transformation (FFT) of the pre-processed signal, the extraction of the frequential components and their amplitudes, the calculation of the pitch and its validation in the frequential domain, the optional elimination of the ambient noise by selective filtering before coding, during the synthesis phase:

the summing of the sines of which the amplitude of the frequential components varies as a function of the envelope of the signal and of which the frequencies vary linearly, the calculation of the phases as a function of the value of the frequencies and of the values of the phases and of the frequencies belonging to the preceding frame, the superimposition of the noise, the application of the envelope.

BRIEF DESCRIPTION OF THE DRAWING FIGURES

An embodiment of the invention is described hereafter, as a non-limiting example, with reference to the appended drawings, in which:

FIG. 2 is a flowchart of the analysis stage;

DETAILED DESCRIPTION OF THE INVENTION

Figure 1:
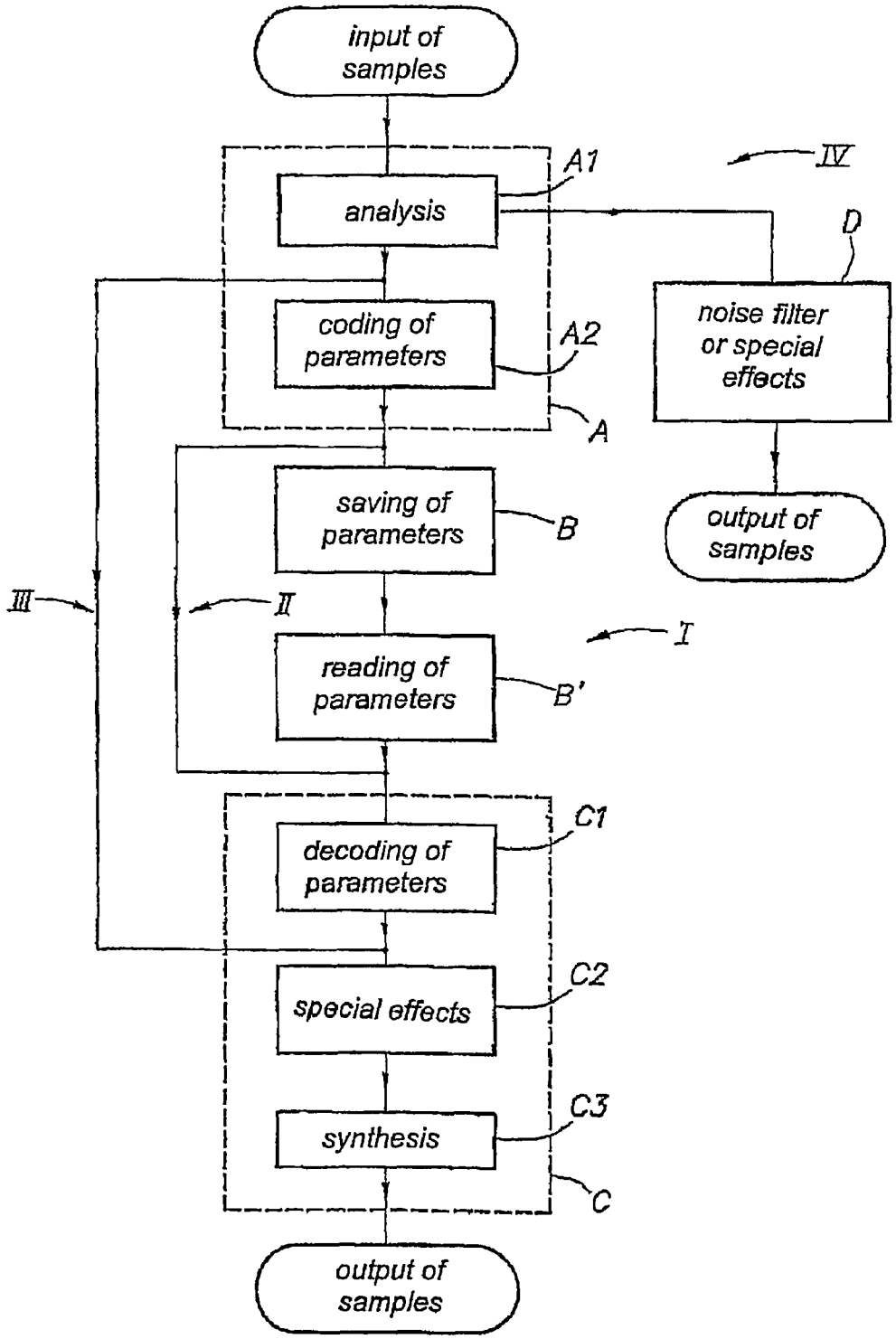
FIG. 1 is a simplified flowchart of the method according to the invention.

In this example, the differentiated digital voice and music processing method according to the invention, shown in FIG. 1, comprises the following stages:

analysis of the vocal signal (block A1), coding of parameters (block A2), saving of parameters (block B), reading of parameters (block B'), decoding of parameters (block C1), special effects (block C2), synthesis (block C3).

Moreover, the analysis of the vocal signal and the coding of the parameters constitute the two functionalities of the analyser (block A); similarly, the decoding of the parameters, the special effects and the synthesis constitute the functionalities of the synthesizer (block C).

These different functionalities are described hereafter, in particular with regard to the different constituent stages of the analysis and synthesis methods.

In general, the differentiated digital voice and music processing method essentially comprises four processing configurations:

the first configuration (path I) comprising the analysis, followed by the coding of the parameters, followed by the saving and by the reading of the parameters, followed by the decoding of the parameters, followed by the special effects, followed by the synthesis, the second configuration (path II) comprising the analysis, followed by the coding of the parameters, followed by the decoding of the parameters, followed by the special effects, followed by the synthesis, the third configuration (path III) comprising the analysis, followed by the special effects, followed by the synthesis, the fourth configuration (path IV) comprising the noise filter or the generation of special effects from the analysis, without passing through the synthesis.

These different possibilities are offered for the appreciation of the user of the device implementing the aforementioned method, which device will be described later.

In this example, the phase of analysis of the audio signal (block A1), shown in FIG. 2, comprises the following stages:

shaping of the input signal (block 1), calculation of the temporal envelope (block 2), detection of temporal interpolation (block 3), detection of the audible signal (block 4), calculation of the temporal interpolation (block 5), calculation of the dynamic range of the signal (block 6), detection of an inaudible frame after a frame of higher energy (block 7), pulse processing, repetition of the pulse (block 9), calculation of the Fast Fourier Transformation (FFT) on repeated pulse (block 10), calculation of the parameters of the signal used for the preprocessing before the FFT (block 11), preprocessing of the temporal signal (block 12), calculation of the FFT on processed signal (block 13), calculation of the signal-to-noise ratio (block 14), test of the Doppler variation of the pitch (block 15), calculation of the FFT on unprocessed signal (block 16), calculation of the signal-to-noise ratio (block 17), comparison of the signal-to-noise ratios with and without preprocessing (block 18), restitution of the result of the FFT with preprocessing (block 19), calculation of the frequencies and moduli (amplitudes of the frequential components (block 20),
decision of the type of signal (block 21),
test of the 50 or 60 Hz (block 22),
calculation of the dynamic range of the moduli in the frequential domain (block 23),
suppression of the interpolation on the frequential data (block 24),
suppression of the inaudible signal (block 25),
calculation and validation of the pitch (block 26),
decision if noise filtering or special effects, or continuation of the analysis (block 27),
optional attenuation of the ambient noise (block 28),
end of processing of the frame (block 29).

The use of the Fast Fourier Transformation (FFT) for the voice cannot be considered given the variability of the frequential signal; in fact the variation of the frequencies creates a spreading of the result of the Fast Fourier Transformation (FFT); the elimination of this spreading is made possible by means of the calculation of the variation of the pitch and by the application of the inverse variation of the pitch on the temporal signal.

Thus, the analysis of the vocal signal is carried out essentially in four stages:

calculation of the envelope of the signal (block 2),
calculation of the pitch and of its variation (block 12),
application of the inverse variation of the pitch to the temporal signal (block 12),
Fast Fourier Transformation (FFT) on the preprocessed signal (block 13),
optional elimination of the ambient noise before coding (blocks 23 to 28).

Moreover, four thresholds (blocks 4, 7, 8, 22) make it possible to detect respectively the presence of inaudible signal, the presence of inaudible frame, the presence of a pulse and the presence of mains interference signal (50 Hz or 60 Hz).

Furthermore, a fifth threshold (block 15) makes it possible to carry out the Fast Fourier Transformation (FFT) on the unprocessed signal as a function of the characteristics of the pitch and of its variation.

A sixth threshold (block 18) makes it possible to retrieve the result of the Fast Fourier Transformation (FFT) with preprocessing as a function of the signal-to-noise ratio.

Finally, a decision is made (block 27) if the noise filtering or the special effects are carried out; in the opposite case, the analysis is continued (arrow IV).

Two frames are used in the method of analysis of the audio signal, a frame called the current frame, of fixed periodicity, containing a certain number of samples corresponding with the vocal signal, and a frame called the analysis frame, of which the number of samples is equivalent to that of the current frame or double, and being able to be shifted, as a function of the temporal interpolation, with respect to said current frame.

The shaping of the input signal (block 1) consists in carrying out a high pass filtering in order to improve the future coding of the frequential amplitudes by increasing their dynamic range; said high pass filtering increases the dynamic range of frequential amplitude whilst preventing an inaudible low frequency from occupying the whole dynamic range and making frequencies of low amplitude but nevertheless audible disappear. The filtered signal is then sent to block 2 for determination of the temporal envelope.

The calculation of the temporal envelope (block 2) makes it possible to define:

the type of signal, if it is a pulse with or without background signal (ambient noise or music),
the position of the analysis frame of the envelope of the signal with respect to the current frame,
the energy of the temporal signal.

It is carried out by a search for the maxima of the signal, considered as the highest part of the pitch in absolute value.

Then the time shift to be applied to the analysis frame is calculated by searching, on the one hand for the maximum of the envelope in said frame then, on the other hand, for two indices corresponding to the values of the envelope less than the value of the maximum by a certain percentage.

If in an analysis frame a difference is found locally between two samples greater than a percentage of the maximum dynamic range of the frame and this during a limited duration, it is declared that a short pulse is contained in the frame by forcing the time shift indices to the values surrounding the additional pulse.

The detection of temporal interpolation (block 3) makes it possible to correct the two analysis frame shift indices found in the preceding calculation, and to do this by taking the past into account.

A first threshold (block 4) detects or does not detect the presence of an audible signal by measuring the maximum value of the envelope; in the affirmative, the analysis of the frame is terminated; in the opposite case, the processing continues.

A calculation of the parameters associated with the time shift of the analysis frame is then carried out (block 5) by determining the interpolation parameter of the moduli which is equal to the ratio of the maximum envelope in the current frame to that of the shifted frame.

The dynamic range of the signal is then calculated (block 6) for its normalisation in order to reduce the calculation noise; the normalisation gain of the signal is calculated from the sample that is highest in absolute value in the analysis frame.

A second threshold (block 7) detects or does not detect the presence of a frame that is inaudible due to the masking effect caused by the preceding frames; in the affirmative, the analysis is terminated; in the opposite case, the processing continues.

A third threshold (block 8) then detects or does not detect the presence of a pulse; in the affirmative, a specific processing is carried out (blocks 9, 10); in the opposite case, the calculations of the parameters of the signal (block 11) used for the preprocessing of the temporal signal (block 12) are carried out.

In the presence of a pulse, the repetition of the pulse (block 9) is carried out by creating an artificial pitch, equal to the duration of the pulse, in order to avoid the masking of the useful frequencies during the Fast Fourier Transformation (FFT).

The Fast Fourier Transformation (FFT) (block 10) is then carried out on the repeated pulse by retaining only the absolute value of the complex number and not the phase; the calculation of the frequencies and of the moduli of the frequential data (block 20) is then carried out.

In the absence of pulse, the calculation of the parameters of the signal (block 11) is carried out, said parameters concerning:

the calculation of the pitch and of its variation,
the definition of the number of samples in the analysis frame.

In fact, the calculation of the pitch is carried out previously by a differentiation of the signal of the analysis frame, followed by a low pass filtering of the components of high rank, then by a raising to the cube of the result of said filtering; the value of the pitch is determined by the calculation of the minimum distance between a portion of high energy signal and the continuation of the subsequent signal subsequent, given that said minimum distance is the sum of the absolute value of the differences between the samples of the frame and the samples to be correlated; then, the main part of a pitch centred about one and a half times the value of the pitch is searched for at the start of the analysis frame in order to calculate the distance of this portion of pitch over the whole of the analysis frame; thus, the minimal distances define the positions of the pitch, the pitch being the mean of the detected pitches; then the variation of the pitch is calculated using a straight line which minimizes the mean square error of the successions of the detected pitches; the pitch estimated at the start and at the end of the analysis frame is derived from it; if the end of frame temporal pitch is higher than the start of frame pitch, the variation of the pitch is equal to the ratio of the pitch estimated at the start of the frame to that at the end of the frame, reduced by 1; conversely, if the temporal pitch at the end of the frame is less than that at the start of the frame, the variation of the pitch is equal to 1 reduced by the ratio of the pitch estimated at the end of the frame to that at the start of the frame.

The variation of the pitch, found and validated previously, is subtracted from the temporal signal in block 12 of temporal preprocessing, using only the first order of said variation.

The subtraction of the variation of the pitch consists in sampling the over-sampled analysis frame using a sampling step that is inversely proportional to the value of said variation of the pitch.

The over-sampling, with a ratio of two, of the analysis frame is carried out by multiplying the result of the Fast Fourier Transformation (FFT) of the analysis frame by the factor exp(−j*2*PI*k/(2*L_frame), in such a way as to add a delay of half of a sample to the temporal signal used for the calculation of the Fast Fourier Transformation; the reverse Fast Fourier Transformation is then carried out in order to obtain the temporal signal shifted by half a sample.

A frame of double length is thus produced by alternately using a sample of the original frame with a sample of the frame shifted by half a sample.

After elimination of the variation of the pitch, said the pitch seems identical over the whole of the analysis window, which will give a result of the Fast Fourier Transformation (FFT) without spread of frequencies; the Fast Fourier Transformation (FFT) can then be carried out in block 13 in order to know the frequential domain of the analysis frame; the method used makes it possible to calculate rapidly the modulus of the complex number to the detriment of the phase of the signal.

The calculation of the signal-to-noise ratio is carried out on the absolute value of the result of the Fast Fourier Transformation (FFT); the ratio is in fact the ratio of the difference between the energy of the signal and of the noise to the sum of the energy of the signal and of the noise; the numerator of the ratio corresponds to the logarithm of the difference between two energy peaks, respectively of the signal and of the noise, the energy peak being that which is either higher than the four adjacent samples corresponding with the harmonic signal, or lower than the four adjacent samples corresponding with the noise; the denominator is the sum of the logarithms of all the peaks of the signal and of the noise; moreover, the calculation of the signal-to-noise ratio is carried out in sub-bands, the highest sub-bands, in terms of level, are averaged and give the sought ratio.

The calculation of the signal-to-noise ratio, defined as being the ratio between the signal minus the noise to the signal plus the noise, carried out in block 14, makes it possible to determine if the analysed signal is a voiced or music signal, the case of a high ratio, or noise, the case of a low ratio.

This distinction is then made in block 15; in fact, tests are carried out on the Doppler variation of the pitch and on the frequency of the pitch; if the variation of the pitch is low or its frequency high, the processing is immediately followed by the calculation of the frequencies and of the moduli of the frequential data of the Fast Fourier Transformation (FFT) (block 20); in the opposite case, the Fast Fourier Transformation(FFT) is carried out without preprocessing (block 16).

The calculation of the signal-to-noise ratio is then carried out in block 17, in order to transmit to block 20 the results of the Fast Fourier Transformation (FFT) without preprocessing, the case of a zero variation of the pitch, or, in the opposite case to retrieve the results of the Fast Fourier Transformation (FFT) with preprocessing (block 19).

This distinction is made in block 18, in the following way:

if the signal-to-noise ratio without preprocessing is higher than the signal-to-noise ratio with preprocessing, the results of the Fast Fourier Transformation (FFT) are transferred to block 20, if the signal-to-noise ratio without preprocessing is lower than the signal-to-noise ratio with processing, the retrieval of the results of the Fast Fourier Transformation (FFT) with preprocessing being carried out in block 19, the results obtained with preprocessing are then transferred to block 20.

This test makes it possible to validate the variation of the pitch, which could be non-zero for music, whereas the latter must effectively be zero.

The calculation of the frequencies and of the moduli of the frequential data of the Fast Fourier Transformation (FFT) is carried out in block 20.

The Fast Fourier Transformation (FFT), previously mentioned with reference to blocks 10, 13, 16, is carried out, by way of example, on 256 samples in the case of a shifted frame or of a pulse, or on double the amount of samples in the case of a centred frame without a pulse.

A weighting of the samples situated at the extremities of the samplings, called HAMMING weighting, is carried out in the case of the Fast Fourier Transformation (FFT) on n samples; on 2n samples, the HAMMING weighting window is used multiplied by the square root of the HAMMING window.

From absolute values of the complex data of the Fast Fourier Transformation (FFT), there is calculated the ratio between two adjacent maximal values, each one representing the product of the amplitude of the frequential component and a cardinal sine; by successive approximations, this ratio between the maximal values is compared with the values contained in tables, containing this same ratio, for N frequencies (for example 32 or 64) distributed uniformly over a half sample of the Fast Fourier Transformation (FFT). The index of the table which defines the ratio closest to that to be compared gives, on the one hand, the modulus and, on the other hand, the frequency for each maximum of the absolute value of the Fast Fourier Transformation (FFT).

Moreover, the calculation of the frequencies and of the moduli of the frequential data of the Fast Fourier Transformation (FFT), carried out in block 20, also makes it possible to detect a DTMF (Dual Tone Multi-Frequency) signal in telephony.

It is to be noted that the signal-to-noise ratio is the essential criterion which defines the type of signal.

In order to determiner the energy of the noise to be generated in the synthesis and the precision of the coding, the signal extracted from block 20 is categorized into four types in bloc 21, namely:

type 0: voiced signal or music.

The pitch and its variation can be non-zero; the noise applied in the synthesis is of low energy; the coding of the parameters is carried out with the maximum precision.

type 1: non-voiced signal and possibly music.

The pitch and its variation are zero; the noise applied in the synthesis is of high energy; the coding of the parameters is carried out with the minimum precision.

type 2: voiced signal or music.

The pitch and its variation are zero; the noise applied in the synthesis is of average energy; the coding of the parameters is carried out with an intermediate precision.

type 3: this type of signal is decided at the end of analysis when the signal to be synthesized is zero.

A detection of the presence or of the non-presence of 50 Hz (60 Hz) interference signal is carried out in block 22; the level of the detection threshold is a function of the level of the sought signal in order to avoid confusing the electromagnetic (50, 60 Hz) interference and the fundamental of a musical instrument.

In the presence of the sought interference signal, the analysis is terminated in order to reduce the bit rate: end of processing of the frame referenced by block 29.

In the opposite case, in the absence of interference signal, the analysis is continued.

A calculation of the dynamic range of the amplitudes of the frequential components, or moduli, is carried out in block 23; said frequential dynamic range is used for the coding as well as for the suppression of inaudible signals carried out subsequently in block 25.

Thus, the frequential plan is subdivided into several parts, each of them has several ranges of amplitude differentiated according to the type of signal detected in block 21.

Furthermore, the temporal interpolation and the frequential interpolation are suppressed in block 24; these having been carried out in order to optimize the quality of the signal.

The temporal interpolation which gives higher moduli is withdrawn by multiplying each modulus by the normalisation parameter calculated in block 5.

The frequential interpolation depends on the variation of the pitch; this is suppressed as a function of the shift of a certain number of samples and of the direction of the variation of the pitch.

The suppression of the inaudible signal is then carried out in block 25. In fact, certain frequencies are inaudible because they are masked by other signals of higher amplitude.

The elimination of these so-called inaudible frequencies will make it possible to reduce the bit rate and also to improve the calculation of the pitch thanks to the suppression of the noise.

Firstly, the amplitudes situated below the lower limit of the frequency range are eliminated, then the frequencies whose interval is less than one frequential unit, defined as being the sampling frequency per sampling unit, are removed.

Then, the inaudible components are eliminated using a test between the amplitude of the frequential component to be tested and the amplitude of the other adjacent components multiplied by an attenuating term that is a function of their frequency difference.

Moreover, the number of frequential components is limited to a value beyond which the difference in the result obtained is not perceptible.

The calculation of the pitch and the validation of the pitch are carried out in block 26; in fact the pitch calculated in block 11 on the temporal signal was determined in the temporal domain in the presence of noise; the calculation of the pitch in the frequential domain will make it possible to improve the precision of the pitch and to detect a pitch that the calculation on the temporal signal, carried out in block 11, would not have determined because of the ambient noise.

Moreover, the calculation of the pitch on the frequential signal must make it possible to decide if the latter must be used in the coding, knowing that the use of the pitch in the coding makes it possible to greatly reduce the coding and to make the voice more natural in the synthesis; it is moreover used by the noise filter.

Given that the frequencies and the moduli of the frame are available, the principle of the calculation of the pitch consists in synthesizing the signal by a sum of cosines originally having zero phase; thus the shape of the original signal is retrieved without the disturbances of the envelope, of the phases and of the variation of the pitch.

The value of the frequential pitch is defined by the value of the temporal pitch which is equivalent to the first synthesis value exhibiting a maximum greater than the product of a coefficient and the sum of the moduli used for the local synthesis (sum of the cosines of said moduli); this coefficient is equal to the ratio of the energy of the signal, considered as harmonic, to the sum of the energy of the noise and of the energy of the signal; said coefficient becoming lower as the pitch to be detected becomes submerged in the noise; as an example, a coefficient of 0.5 corresponds to a signal-to-noise ratio of 0 decibels.

The validation information of the frequential pitch is obtained using the ratio of the synthesis sample, at the place of the pitch, to the sum of the moduli used for the local synthesis; this ratio, synonymous with the energy of the harmonic signal over the total energy of the signal, is corrected according to the approximate signal-to-noise ratio calculated in block 14; the validation of the pitch information depends on exceeding the threshold of this ratio.

In order to avoid validating a pitch on noise or on music, when the detection threshold of the pitch is low, a check of the existence of a pitch is carried out at the locations of the multiples of the temporal pitch in the local synthesis; thus the pitch is not validated if the level of the synthesis is too low to be a pitch at said locations of the multiples of the temporal pitch.

The local synthesis is calculated twice; a first time by using only the frequencies of which the modulus is high, in order to be free of noise for the calculation of the pitch; a second time with the totality of the moduli limited by maximum value, in order to calculate the signal-to-noise ratio which will validate the pitch; in fact the limitation of the moduli gives more weight to the non-harmonic frequencies with a low modulus, in order to reduce the probability of validation of a pitch in music.

In the case of noise filtering, the values of said moduli are not limited for the second local synthesis, only the number of frequencies is limited by taking account of only those which have a significant modulus in order to limit the noise.

A second method of calculation of the pitch consists in selecting the pitch which gives the maximum energy for a sampling step of the synthesis equal to the sought pitch; this method is used for music or a sonorous environment comprising several voices.

Prior to the last stage consisting in attenuating the noise, the user decides if he wishes to carry out noise filtering or to generate special effects (block 27), from the analysis, without passing through the synthesis.

In the opposite case, the analysis will be terminated by the next processing consisting in attenuating the noise, in block 28, by reducing the frequential components which are not a multiple of the pitch; after attenuation of said frequential components, the suppression of the inaudible signal will be carried out again, as described previously, in block 25.

The attenuation of said frequential components is a function of the type of signal as defined previously by block 21.

After having carried out said attenuation of the noise, it can be considered that the processing of the frame is terminated; the end of said analysis phase is referenced by block 29.

Figure 3:
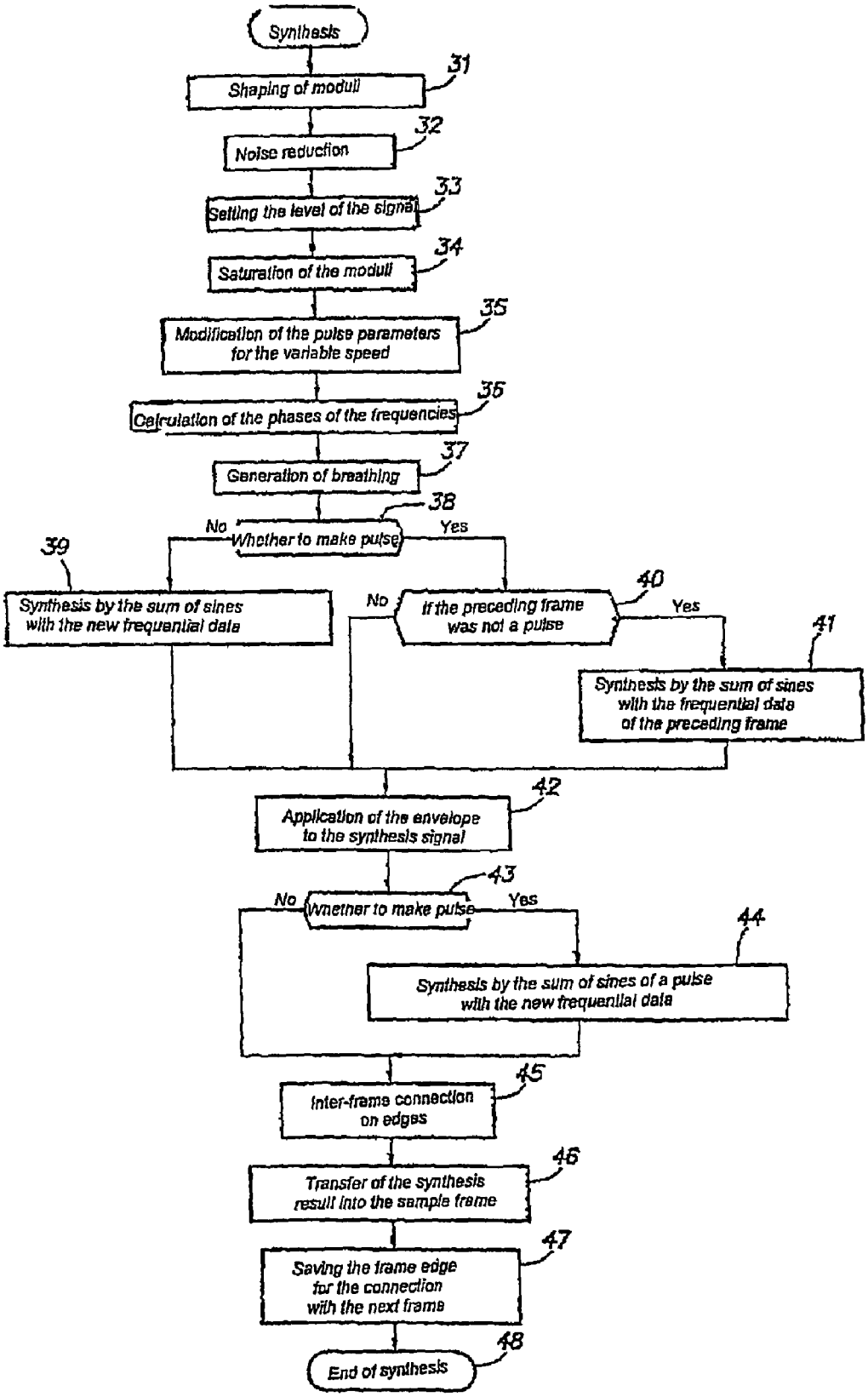
FIG. 3 is a flowchart of the synthesis stage.

With reference to FIG. 1 representing a simplified flowchart of the method according to the invention, in this example, the phase of synthesis of the audio signal (block C3), represented according to the FIG. 3, comprises the following stages:

- shaping of the moduli (block 31),
- noise reduction (block 32),
- setting the signal level (block 33),
- saturation of the moduli (block 34),
- modification of the pulse parameters as a function of the speed of the synthesis (block 35),
- calculation of phases (block 36),
- generation of breathing (block 37),
- decision concerning the generation of a pulse (block 38),
- synthesis with the frequential data of the current frame (block 39),
- test concerning the preceding frame (block 40),
- synthesis with the frequential data of the preceding frame (block 41),
- application of the envelope to the synthesis signal (block 42),
- decision concerning the adding of a pulse (block 43),
- synthesis with the new frequential data (block 44),
- connection between adjacent frames (block 45),
- transfer of the synthesis result into the sample frame (block 46),
- saving the frame edge (block 47),
- end of synthesis (block 48).

The synthesis consists in calculating the samples of the audio signal from the parameters calculated by the analysis; the phases and the noise are calculated artificially depending on the context.

The shaping of the moduli (block 31) consists in eliminating the attenuation of the analysis samples input filter (block 1 of block A1) and in taking account of the direction of the variation of the pitch since the synthesis is carried out temporally by a phase increment of a sine.

Moreover, the pitch validation information is suppressed if the synthesis of music option is validated; this option improves the phase calculation of the frequencies by avoiding the synchronizing of the phases of the harmonics with each other as a function of the pitch.

The noise reduction (block 32) is carried out if this has not been carried out previously during the analysis (block 28 of block A1).

The level setting of the signal (block 33) eliminates the normalisation of the moduli received from the analysis; this level setting consists in multiplying the moduli by the inverse of the normalisation gain defined in the calculation of the dynamic range of the signal (block 6 of block A1) and in multiplying said moduli by 4 in order to eliminate the effect of the HAMMING window, and in that only half of the frequential plan is used.

The saturation of the moduli (block 34) is carried out if the sum of the moduli is greater than the dynamic range of the signal of the output samples; it consists in multiplying the moduli by the ratio of the maximal value of the sum of the moduli to the sum of the moduli, in the case where said ratio is less than 1.

The pulse is regenerated by producing the sum of sines in the pulse duration; the pulse parameters are modified (block 35) as a function of the variable speed of synthesis.

The calculation of the phases of the frequencies is then carried out (block 36); its purpose is to give a continuity of phase between the frequencies of the frames or to resynchronize the phases with each other; moreover it makes the voice more natural. The synchronisation of the phases is carried out each time that a new signal in the current frame seems separated in the temporal domain or in the frequential domain of the preceding frame; this separation corresponds:

- to the change from a noisy signal to a non-noisy signal,
- to a start of word (or sound) of which the envelope at the start of frame is weak,
- to a transition between two words (or sounds) without variation of the envelope,
- to a start of word (or sound) which has been detected in the preceding frame but of which the rising of the envelope in the current frame is such that the synchronisation must be repeated so that the phases are calculated as a function of a pitch of better quality.

The continuity of phase consists in searching for the start-of-frame frequencies of the current frame which are the closest to the end-or-frame frequencies of the preceding frame; then the phase of each frequency becomes equal to that of the closest preceding frequency, knowing that the frequencies at the start of the current frame are calculated from the central value of the frequency modified by the variation of the pitch.

In the presence of a pitch, the case of a voiced signal, the phases of the harmonics are synchronized with that of the pitch by multiplying the phase of the pitch by the index of the harmonic of the pitch; with regard to phase continuity, the end-of-frame phase of the pitch is calculated as a function of its variation and of the phase at the start of the frame; this phase will be used for the start of the next frame.

A second solution consists in no longer applying the variation of the pitch to the pitch in order to know the new phase; it suffices to reuse the phase of the end of the preceding frame of the pitch; moreover, during the synthesis, the variation of the pitch is applied to the interpolation of the synthesis carried out without variation of the pitch.

The generation of breathing is then carried out (block 37).

According to the invention, it is considered that any sonorous signal in the interval of a frame is the sum of sines of fixed amplitude and of which the frequency is modulated linearly as a function of time, this sum being modulated temporally by the envelope of the signal, the noise being added to this signal prior to said sum. Without this noise, the voice is metallic since the elimination of the weak moduli, carried out in block 25 of block A3, essentially relates to breathing.

Moreover, the estimation of the signal-to-noise ratio carried out in block 14 of block A3, is not used; in fact a noise is calculated as a function of the type of signal, of the moduli and of the frequencies.

The principle of the calculation of the noise is based on a filtering of white noise by a transversal filter whose coefficients are calculated by the sum of the sines of the frequencies of the signal whose amplitudes are attenuated as a function of the values of their frequency and of their amplitude. A HAMMING window is then applied to the coefficients in order to reduce the secondary lobes.

The filtered noise is then saved in two separate parts.

A first part will make it possible to produce the link between two successive frames; the connection between two frames is produced by overlapping these two frames each of which is weighted linearly and inversely; said overlapping is carried out when the signal is sinusoidal; it is not applied when it is uncorrelated noise; thus the saved part of the filtered noise is added without weighting in the overlap zone.

The second part is intended for the main body of the frame.

The link between two frames must, on the one hand, allow a smooth passage between two noise filters of two successive frames and, on the other hand, extend the noise of the following frame beyond the overlapping part of the frames if a start of word (or sound) is detected.

Thus, the smooth passage between two frames is produced by the sum of the white noise filtered by the filter of the preceding frame, weighted by a linearly falling slope, and the same white noise filtered by the noise filter of the current frame weighted by the rising slope that is the inverse of that of the filter of the preceding frame.

The energy of the noise is added to the energy of the sum of the sines, according to the proposed method.

The generation of a pulse differs from a signal without pulse; in fact, in the case of the generation of a pulse, the sum of the sines is carried out only on a part of the current frame to which is added the sum of the sines of the preceding frame.

This distinction makes it necessary to choose (block 38) between the two options: must or must not a pulse be generated?; in the case where there is no generation of a pulse, the synthesis is carried out with the new frequential data (block 39); in the opposite case, it is a matter of knowing if the preceding frame was not a pulse (block 40); in this case the synthesis is carried out with the frequential data of the preceding frame (block 41) which will be used as a background for the pulse (the case of music or of ambient noise to be repeated); in the opposite case, the preceding frame being a pulse, the background signal with the parameters of the preceding pulse is not repeated.

The synthesis with the new frequential data (block 39) consists in producing the sum of the sines of the frequential components of the current frame; the variation of the length of the frame makes it possible to carry out a synthesis at variable speed; however, the values of the frequencies at the start and at the end of the frame must be identical, whatever the length of the frame may be, for a given synthesis data speed. The phase associated with the sine, a function of frequency, is calculated by iteration; in fact, for each iteration, the sine multiplied by the modulus is calculated; the result is then summed for each sample according to all the frequencies of the signal.

Another method of synthesis consists in carrying out the reverse analysis by recreating the frequential domain from the cardinal sine produced with the modulus, the frequency and the phase, and then by carrying out a reverse Fast Fourier Transformation (FFT), followed by the product of the inverse of the HAMMING window in order to obtain the temporal domain of the signal.

In the case where the pitch varies, the reverse analysis is again carried out by adding the variation of the pitch to the over-sampled temporal frame.

In the case of a pulse, it suffices to apply to the temporal signal, a window at 1 during the pulse and at 0, outside of the latter.

In the case of a pulse to be generated, the original phases of the frequential data are maintained at the value 0.

In order to produce a smooth connection between the frames, the calculation of the sum of the sines is also carried out on a portion preceding the frame and on a same portion following the frame; the parts at the two ends of the frame are then summed with those of the adjacent frames by linear weighting.

In the case of a pulse, the sum of the sines is carried out in the time interval of the generation of the pulse; in order to avoid the creation of interference pulses following the discontinuities in the calculation of the sum of the sines, a certain number of samples situated at the start and at the end of the sequence are weighted by a rising slope and by a falling slope respectively.

With regard to the case of the harmonic frequencies of the pitch, the phases have been calculated previously in order to be synchronized, they will be generated from the index of the corresponding harmonic.

The synthesis by the sum of the sines with the data of the preceding frame (block 41) is carried out when the current frame contains a pulse to be generated; in fact, in the case of music or of noise, if the synthesis is not carried out on the preceding frame, used as background signal, the pulse is generated on a silence, which is prejudicial to the good quality of the result obtained; moreover the continuity of the preceding frame is inaudible, even in the presence of a progression of the signal.

The application of the envelope to the synthesis signal (block 42) is carried out from previously determined sampled values of the envelope (block 2 of block A3); moreover the connection between two successive frames is produced by the weighted sum, as indicated previously; this weighting by the rising and falling curves is not carried out on the noise, because the noise is not juxtaposed between frames.

Finally, in the case of the synthesis at variable speed, the length of the frame varies in steps in order to be homogeneous with the sampling of the envelope.

The addition of a pulse by the sum of sines in the interval where the pulse was detected is carried out (block 44) according to the test carried out previously (block 43).

The juxtaposition weighting between two frames is then carried out (block 45) as described previously.

The transfer of the result of synthesis (block 46) is then carried out in the sample output frame in order that said result is saved.

Similarly, the saving of the frame edge (block 47) is carried out in order that said frame edge can be added to the start of the following frame.

The end of said synthesis phase is referenced by the block 48.

Figure 4:
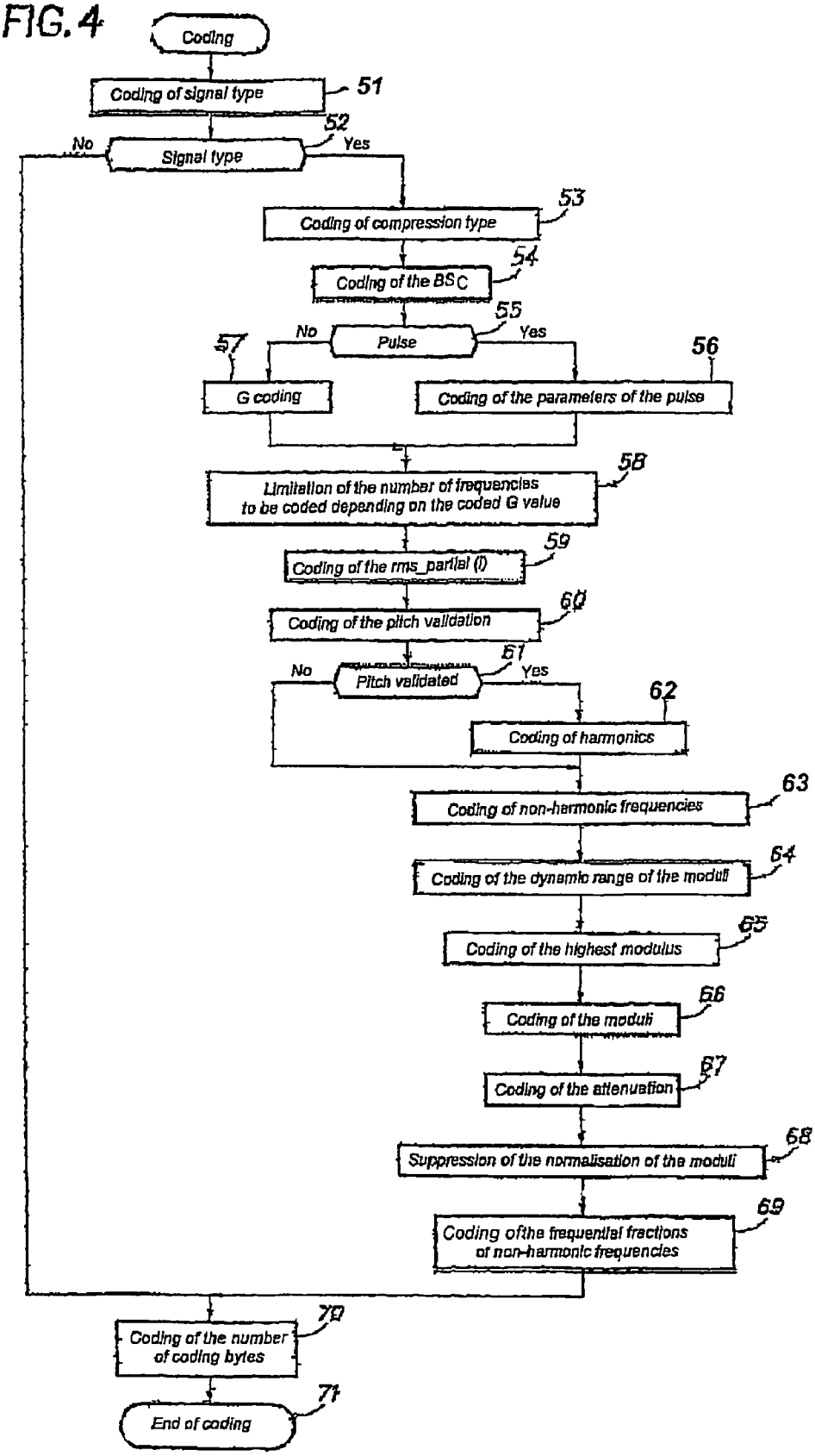
FIG. 4 is a flowchart of the coding stage.

With reference to the FIG. 1, showing a simplified flowchart of the method according to the invention, in this example, the phase of coding the parameters (block A2), shown in FIG. 4, comprises the following stages:

- coding of the type of signal (block 51),
- test of the type of signal (block 52),
- coding of the type of compression (block 53),
- coding of the normalisation value of the frame signal (block 54),
- test of the presence of a pulse (block 55),
- coding of the pulse parameters (block 56),
- coding of the variation of the pitch (block 57),
- limitation of the number of frequencies to be coded (block 58),
- coding of the envelope sampling values (block 59),
- coding of the validation of the pitch (block 60), validation test of the pitch (block 61),
coding of the harmonics (block 62),
coding of the non-harmonic frequencies (block 63),
coding of the dynamic range of the moduli (block 64),
coding of the highest modulus (block 65),
coding of the moduli (block 66),
coding of the attenuation (block 67),
suppression of the normalisation of the moduli (block 68),
coding of the frequential fractions of the non-harmonic frequencies (block 69),
coding of the number of coding bytes (block 70),
end of coding (block 71).

The coding of the parameters (block A2) calculated in the analysis (block A1) in the method according to the invention, consists in limiting the quantity of useful data in order to reproduce, in synthesis (block C3) after decoding (block C1), an auditory equivalent to the original audio signal.

As the coding is of variable length, each coded frame has an appropriate number of bits of information; the audio signal being variable, more or less information will have to be coded.

As the coding parameters are interdependent, a coded parameter will influence the type of coding of the following parameters.

Moreover, the coding of the parameters can be either linear, the number of bits depending on the number of values, or of the HUFFMAN type, the number of bits being a statistical function of the value to be coded (the more frequent the data, the less it uses bits, and vice-versa).

The type of signal, as defined during the analysis (block 21 of block A1), provides the information of noise generation and quality of the coding to be used; the coding of the type of signal is carried out firstly (block 51).

A test is then carried out (block 52) making it possible, in the case of a type 3 signal, as defined in block 21 of the analysis (block A1), not to carry out the coding of the parameters; the synthesis will comprise no samples.

The coding of the type of compression (block 53) is used in the case where the user wishes to act on the coding data rate, to the detriment of the quality; this option can be advantageous in telecommunication mode associated with a high compression rate.

The coding of the normalisation value (block 54) of the signal of the analysis frame is of the HUFFMAN type.

A test for the presence of a pulse (block 55) is then carried out, making it possible, in the case of synthesis of a pulse, to code the parameters of said pulse.

In case of presence of a pulse, the coding, according to a linear law, of the parameters of said pulse (block 56) is carried out on the start and the end of said pulse in the current frame.

With regard to the coding of the Doppler variation of the pitch (block 57), it is carried out according to a logarithmic law, taking account of the sign of said variation; this coding is not carried out in the presence of a pulse or if the type of signal is not voiced.

A limitation of the number of frequencies to code (block 58) is then carried out in order to prevent a high value frequency from exceeding the dynamic range limited by the sampling frequency, given that the Doppler variation of the pitch varies the frequencies during the synthesis.

The coding of the sampling values of the envelope (block 59) depends on the variation of the signal, on the type of compression, on the type of signal, on the normalisation value and on the possible presence of a pulse; said coding consists in coding the variations and the minimal value of said sampling values.

The validation of the pitch is then coded (block 60), followed by a validation test (block 61) necessitating, in the affirmative, coding the harmonic frequencies (block 62) according to their index with respect to the frequency of the pitch. With regard to the non-harmonic frequencies, they will be coded (block 63) according to their whole part.

The coding of the harmonic frequencies (block 62) consists in carrying out a logarithmic coding of the pitch, in order to obtain the same relative precision for each harmonic frequency; the coding of said indices of the harmonics is carried out according to their presence or their absence per packet of three indices according to the HUFFMAN coding.

The frequencies which have not been detected as being harmonics of the frequency of the pitch are coded separately (block 63).

In order to prevent a non-harmonic frequency from changing position with respect to a harmonic frequency at the time of the coding, the non-harmonic frequency which is too close to the harmonic frequency is suppressed, knowing that it has less weight in the audible sense; thus the suppression takes place if the non-harmonic frequency is higher than the harmonic frequency and that the fraction of the non-harmonic frequency, due to the coding of the whole part, makes said non-harmonic frequency lower than the close harmonic frequency.

The coding of the non-harmonic frequencies (block 63) consists in coding the number of non-harmonic frequencies, then the whole part of the frequencies, then the fractional parts when the moduli are coded; concerning the coding of the whole part of the frequencies, only the differences between said whole parts are coded; moreover, the lower the modulus, the lower the precision over the fractional part; this in order to reduce the bit rate.

In order to optimize the coding in terms of data rate of the whole part as a function of the statistics of the frequency differences, a certain number of maximal differences between two frequencies are defined.

The coding of the dynamic range of the moduli (block 64) uses a HUFFMAN law as a function of the number of ranges defining said dynamic range and of the type of signal. In the case of a voiced signal, the energy of the signal is situated in the low frequencies; for the other types of signal, the energy is distributed uniformly in the frequency plan, with a lowering towards the high frequencies.

The coding of the highest modulus (block 65) consists in coding, according to a HUFFMAN law, the whole part of said highest modulus, taking account of the statistics of said highest modulus.

The coding of the moduli (block 66) is carried out only if the modulus number to code is higher than 1, given that in the opposite case it is alone in being the highest module. During the analysis (block A1), the suppression of the inaudible signal (block 25 of block A1) eliminates the moduli lower than the product of the modulus and the corresponding attenuation; thus a modulus must be situated in a zone of the modulus/frequency plan depending on the distance which separates it from its two adjacent moduli as a function of the frequency difference of said adjacent moduli. Thus the value of the modulus is approximated with respect to the preceding modulus according to the frequency difference and to the corresponding attenuation which depends on the type of signal, on the normalisation value and on the type of compression; said approximation of the value of the modulus is carried out with reference to a scale of which the steps vary according to a logarithmic law.

The coding of the attenuation (block 67) applied by the samples input filter is carried out and then is followed by the suppression of the normalisation (block 68) which makes it possible to recalculate the highest modulus as well as the corresponding frequency.

The coding of the frequential fractions of the non-harmonic frequencies (block 69) completes the coding of the whole parts of said frequencies.

The precision of the coding will depend:

on the frequency: the lower the frequency, the higher the precision in order that the coding error rate to frequency ratio may be low, on the type of signal, on the type of compression, on the normalisation value of the signal: the higher intensity of the signal, the more precise the coding.

Finally, the coding of the number of coding bytes (block 70) is carried out at the end of the coding of the different parameters mentioned above, stored in a dedicated coding memory.

The end of said coding phase is referenced by block 71.

With reference to FIG. 1 showing a simplified flowchart of the method according to the invention, in this example, the phase of decoding the parameters is represented by block C1.

As decoding is the reverse of coding, the use of the coding bits of the different parameters mentioned above will make it possible to retrieve the original values of the parameters, with possible approximations.

With reference to FIG. 1 showing a simplified flowchart of the method according to the invention, in this example, the phase of filtering the noise and of generation of special effects, from the analysis, without passing through the synthesis is indicated by block D.

Noise filtering is carried out from the parameters of the voice calculated in the analysis (block A1 of block A), following path IV indicated on said simplified flowchart of the method according to the invention.

It turns out that the algorithms known in the prior art carry out a cancellation of the noise based on the statistical properties of the signal; as a result the noise must be statistically static; this procedure does not therefore allow the presence of noise in harmonic form (voice, music).

Consequently, the objective of noise filtering is to reduce all kinds of noise such as: the ambient noise of a car, engine, crowd, music, other voices if these are weaker than those to be retained, as well as the calculation noises of any vocoder (for example: ADPCM, GSM, G723).

Moreover, the majority of noises have their energy in the low frequencies; the fact of using the signal of the analysis previously filtered by the samples input filter makes it possible to reduce the very low frequency noise accordingly.

Noise filtering (block D) for a voiced signal consists in producing the sum, for each sample, of the original signal, of the original signal shifted by one pitch in positive value and of the original signal shifted by one pitch in negative value. This necessitates knowing, for each sample, the value of the pitch and of its variation. Advantageously, the two shifted signals are multiplied by a same coefficient and the original non-shifted signal by a second coefficient; the sum of said first coefficient added to itself and of said second coefficient is equal to 1, reduced in order to retain an equivalent level of the resultant signal.

The number of samples spaced by one temporal pitch is not limited to three samples; the more samples used for the noise filter, the more the filter reduces the noise. The number of three samples is adapted to the highest temporal pitch encountered in the voice and to the filtering delay. In order to keep a fixed filtering delay, the smaller the temporal pitch, the more it is possible to use samples shifted by one pitch in order to carry out the filtering; this amounts to keeping the pass band around a harmonic almost constant; the higher the fundamental, the greater the attenuated bandwidth.

Moreover, noise filtering does not concern pulse signals; it is therefore necessary to detect the presence of possible pulses in the signal.

Noise filtering (block D) for a non-voiced signal consists in attenuating said signal by a coefficient less than 1.

In the temporal domain, the sum of the three signals mentioned above is correlated; with regard to the noise contained in the original signal, the summing will attenuate its level.

Thus, it is necessary to know exactly the variation of the pitch, i.e. the temporal value of the pitch, approximated as a linear value, knowing that it makes use of a second order term; the improvement of the precision of the said two shifts, positive and negative, is obtained thanks to the use of correlation by distance at the start, middle and end of frame; this procedure was described during the "calculation of the parameters of the signal" stage (block 11 of block A1).

Advantageously, the previously described noise filtering makes it possible to generate special effects; said generation of special effects makes it possible to obtain:

a feminization of the voice, by dividing the temporal value of the pitch by two, for certain values of the amplitudes of the original signal and of the shifted original signals; this artificially multiplies the frequency of the pitch of the voice by two by deleting the odd harmonics;

an artificial and strange voice, by dividing the temporal value of the pitch by two, for other values of the amplitudes of the original signal and of the shifted original signals; this makes it possible to retain only the odd harmonics;

two different voices, by dividing the temporal value of the pitch by two, for different values of the amplitudes of the original signal and of the shifted original signals; this makes it possible to attenuate the odd harmonics.

Finally, another procedure, similar to the previously described one allowing noise filtering, can be applied, not in order to filter the noise but to divide the fundamental of the voice by two or by three and to do this without modification of the formant (spectral envelope) of said voice.

The principle of said procedure consists:

in multiplying each sample of the original voice by a cosine varying with the rhythm of half of the fundamental (multiplication by two of the number of frequencies), or varying with the rhythm of one third of the fundamental (multiplication by three of the number of frequencies), and then in adding the result obtained to the original voice.

Moreover, the phase of noise filtering and of generation of special effects, from the analysis, without passing through the synthesis, cannot include the calculation of the variation of the pitch; this makes it possible to obtain an auditory quality close to that previously obtained according to the abovementioned method; in this operational mode, the functions defined by the blocks 11, 12, 15, 16, 17, 18, 19, 25 and 28 are suppressed.

With reference to FIG. 1, showing a simplified flowchart of the method according to the invention, in this example, the phase of generation of special effects, associated with the synthesis (block C3) is indicated by block C2 of block C.

Said phase of generation of special effects, associated with the synthesis, makes it possible to transform voice or music:

either by modifying, according to certain laws, the decoded parameters coming from block C1 (path II), or by directly processing the results of the analysis coming from block A1 (path III).

The modified parameters are:

the pitch, the variation of the pitch, the validation of the pitch, the number of frequential components, the frequencies, the moduli, the indices.

The frequencies being distinct from each other, their transformation makes it possible to make the voice younger, or to make it older, to feminize it or vice-versa or to transform it into an artificial voice. Thus the transformation of the moduli allows any kind of filtering and furthermore makes it possible to retain the natural voice by keeping the formant (spectral envelope).

As examples, three types of transformation of the voice are described hereafter, each one being referenced by its own name namely:

the "Transform" function modifying the voice artificially and making it possible to create a choral effect, the "Transvoice" function modifying the voice realistically, the "Formant" function associated with the "Transvoice" function.

La "Transform" function consists in multiplying all the frequencies of the frequential components by a coefficient. The modifications of the voice depend on the value of this coefficient, namely:

a value greater than 1 transforms the voice into a duck-like voice, a value slightly greater than 1 makes the voice younger, a value less than 1 makes the voice lower.

In fact, this artificial rendering of the voice is due to the fact that the moduli of the frequential components are unchanged and that the spectral envelope is deformed. Moreover, by synthesizing the same parameters, modified by said "Transform" function with a different coefficient, several times, a choral effect is produced by giving the impression that several voices are present.

The "Transvoice" function consists in recreating the moduli of the harmonics from the spectral envelope, the original harmonics are abandoned knowing that the non-harmonic frequencies are not modified; in this respect, said "Transvoice" function makes use of the "Formant" function which determines the formant.

Thus, the transformation of the voice is carried out realistically since the formant is retained; a multiplication coefficient of the harmonic frequencies greater than 1 makes the voice younger, or even feminizes it; conversely, a multiplication coefficient of the harmonic frequencies less than 1 makes the voice lower.

Moreover, in order to maintain a constant sound level, independently of the value of the multiplication coefficient, the new amplitudes are multiplied by the ratio of the sum of the input moduli of said "Transvoice" function to the sum of the output moduli.

The "Formant" function consists in determining the spectral envelope of the frequential signal; it is used for keeping the moduli of the frequential components constant when the frequencies are modified.

The determination of the envelope is carried out in two stages, namely:

a filtering of the moduli placed in the envelope, a logarithmic interpolation of the envelope between two moduli of a harmonic.

Said "Formant" function can be applied during the coding of the moduli, of the frequencies, of the amplitude ranges and of the fractions of frequencies by carrying out said coding only on the essential parameters of the formant, the pitch being validated. In this case, during the decoding, the frequencies and the moduli are recalculated from the pitch and from the spectral envelope respectively. Thus the bit rate is reduced; this procedure is however applicable only to the voice.

Said previously described "Transform" and "Transvoice" functions make use of a constant multiplication coefficient of the frequencies. This transformation can be non-linear and make it possible to render the voice artificial.

In fact, if this multiplication coefficient is dependent on the ratio between the new pitch and the real pitch, the voice will be characterized by a fixed and a variable formant; it will thus be transformed into a robot-like voice associated with a space effect.

If this multiplication coefficient varies periodically or randomly, at low frequency, the voice is aged as associated with a mirth-provoking effect.

These different transformations of the voice, obtained from a modification, constant or variable in time, of the frequencies, said modification being carried out on each one of the frequencies taken separately, are given as examples.

A final solution consists in carrying out a fixed rate coding. The type of signal is reduced to a voiced signal (type 0 and 2 with the validation of the pitch at 1), or to noise (type 1 and 2 with the validation of the pitch at 0). As type 2 is for music, it is eliminated in this case, since this coding can code only the voice.

The fixed rate coding consists in:

coding the type of signal, the information of the presence of pulse, and the validation of the pitch in HUFFMAN coding, coding the location of the pulse in the frame if no pulse is present, otherwise coding the parts of temporal envelope making use of a coding table representing the envelopes most commonly encountered, coding the pitch in logarithmic law on its value or the difference between the coded pitch of the preceding frame and that of the current frame;

it should be noted that differential coding makes it possible to use fewer coding bits, coding the variation of the pitch, not being in the presence of a pulse, only if the value calculated in the analysis is distant by a certain percentage from the variation of pitch calculated from the pitches of the preceding frame and of the current frame; similarly, the variation of the pitch is not coded if the absolute value of the difference between these two variations is less than a maximal value, coding the differential formant in 2 bits for the low frequencies, and in 1 bit for the other frequencies, the first formant not being differentially coded. It should be noted that the more samples of formant there are to code, the better is the auditory quality the fixed rate coder, and the less is the coding difference between two adjacent samples.

As decoding is the reverse of coding, the pitch provides all the harmonics of the voice; their amplitudes are those of the formant.

With regard to the frequencies of the non-voiced signal, frequencies are calculated spaced from each other by an average value to which is added a random difference; the amplitudes are those of the formant.

The synthesis method, described previously, is identical to that described for a variable rate decoder.

Figure 5:
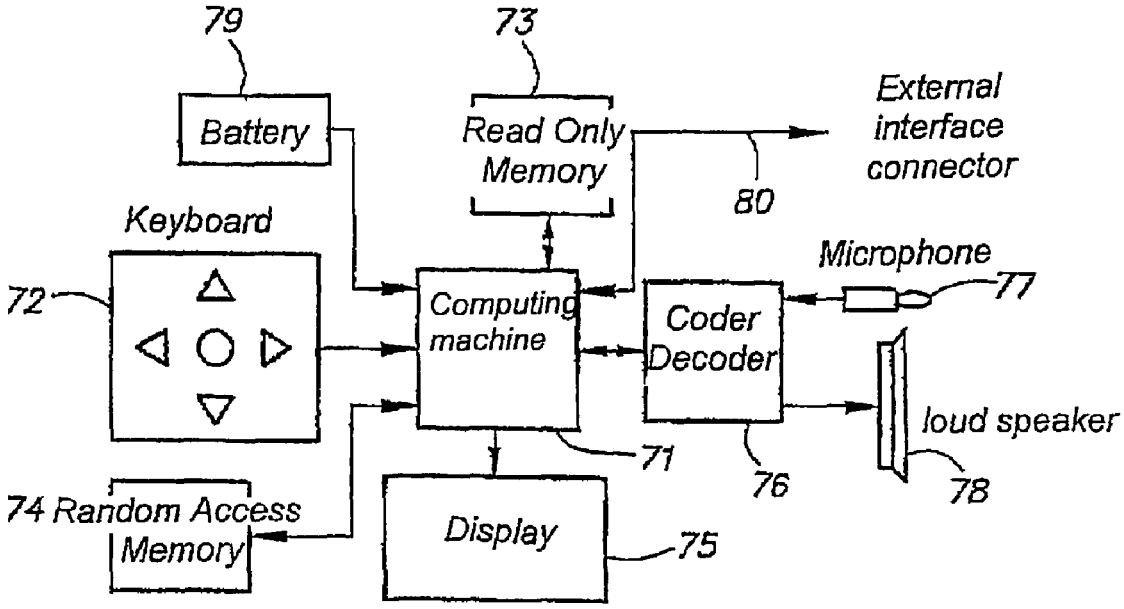
FIG. 5 is a block diagram of a device according to the invention.

In order to allow the carrying out of the method according to the invention, a device is described hereafter, with reference to the FIG. 5.

The device, according to the invention, essentially comprises:

a computing machine 71, of the DSP type, making it possible to carry out the digital processing of the signals, a keyboard 72 making it possible to select the voice processing menus, a read only memory 73, of the EEPROM type, containing the voice processing software, a random access memory 74, of the flash or "memory stick" type, containing the recordings of the processed voice, a display 75, of the LCD type, coupled with the keyboard 72, showing the different voice processing menus, a coder/decoder 76, of the codec type, providing the input/output links for the audio peripherals, a microphone 77, of the electret type, a loud speaker 78, a battery 79, an input/output link 80, making it possible to transfer the digital recordings and the updates of the voice processing software.

Moreover, the device can comprise:

a telephonic connector making it possible for the device according to the invention to be substituted for a telephonic handset, a mobile telephony connector, a headphones output, making it possible to listen to the recordings, a hi-fi system output, allowing the karaoke function, an external power supply connector.

More precisely, the device can comprise:

analysis means making it possible to determine parameters representative of the sound signal, the analysis means comprising:

means of calculation of the envelope of the signal, means of calculation of the pitch and of its variation, means of application of the inverse variation of the pitch to the temporal signal, means for the Fast Fourier Transformation (FFT) of the preprocessed signal, means of extraction of the frequential components and their amplitudes from the signal, from the result of the Fast Fourier Transformation, means of optional elimination of the ambient noise by selective filtering before coding, means of synthesis of said representative parameters making it possible to reconstitute said sound signal, said means of synthesis comprising:

means of summing sines of which the amplitude of the frequential components varies as a function of the envelope of the signal, means of calculation of phases as a function of the value of the frequencies and of the values of the phases and of the frequencies belonging to the preceding frame, means of superimposition of noise, means of application of the envelope, means of noise filtering and of generation of special effects, from the analysis, without passing through the synthesis, said means of noise filtering and of generation of special effects comprising:

means of summing of the original signal, of the original signal shifted by one pitch in positive value and of the signal original shifted by one pitch in negative value, means of division of the temporal value of the pitch by two, means of modification of the amplitudes of the original signal and of the two shifted signals, means of multiplication of each sample of the original voice by a cosine varying at the rhythm of half of the fundamental (multiplication by two of the number of frequencies), or varying at the rhythm of one third of the fundamental (multiplication by three of the number of frequencies), means of then adding the result obtained to the original voice, means of generation of special effects associated with the synthesis, said means of generation of special effects comprising:

means of multiplication of all the frequencies of the frequential components of the original signal, taken individually, by a coefficient, means of regeneration of the moduli of the harmonics from the spectral envelope of said original signal.

Advantageously, the device can comprise all the elements mentioned previously, in a professional or semi-professional version; certain elements, such as the display, can be simplified in a basic version.

Thus, the device according to the invention, as described above, can implement the method for differentiated digital voice and music processing, noise filtering and the creation of special effects.

In particular it will make it possible to transform the voice:

into another realistic voice, for a karaoke type use, into another futuristic, strange or accompanying voice.

It will also make it possible:

to suppress the ambient noise and to increase recording capacities, to transfer the recordings onto computer hard disk and to listen to them again at variable speed, to produce a "hands free" function coupled with a mobile telephone, to generate an auditory response adapted to the hard of hearing.

The invention claimed is:

1. A method for differentiated digital processing of a sound signal, constituted in an interval of a frame by a sum of sines of fixed amplitude and of which a frequency is modulated linearly as a function of time, this sum being modulated temporally by an envelope, a noise of said sound signal being added to said signal, prior to said sum, comprising:

a stage of analyzing making it possible to determine parameters representing said sound signal by calculating the envelope of the signal, calculating the sound signal of the pitch and its variation, applying to a temporal signal of an inverse variation of the pitch a temporal sampling of the sound signal with a variable sampling step, this step varying with an inverse value of the pitch variation, performing a Fast Fourier Transformation (FFT) of a preprocessed signal, extracting signal frequential components and their amplitudes from a result of the Fast Fourier Transformation, and calculating the pitch in a frequential domain and its variation with respect to the previously calculated pitch in order to improve a precision of the previously calculated pitch.

2. The method according to claim 1, wherein the method further comprises a stage of synthesizing said representative parameters making it possible to reconstitute said sound signal.

3. The method according to claim 2,
wherein said stage of synthesizing comprises:
summing of the sines of which the amplitude of the frequential components varies as a function of the envelope of the signal and of which the frequencies vary linearly,
calculating the phases as a function of the frequencies value and of the values of phases and frequencies belonging to the preceding frame,
superimposing the noise, and
applying the envelope.

4. The method according to claim 1,
wherein the method further comprises a stage of coding and of decoding of said representative parameters of said sound signal.

5. The method according to claim 1,
wherein the method further comprises a stage of filtering of the noise and a stage of generating special effects, from the analysis, without carrying out a the synthesis.

6. The method according to claim 5,
wherein said stage of filtering of the noise and said stage of generating special effects, from the analysis, without carrying out the synthesis, comprise a sum of the original signal, of the original signal shifted by one pitch in positive value and of the original signal shifted by one pitch in negative value.

7. The method according to claim 6,
wherein said shifted signals are multiplied by a same coefficient, and the original signal by a second coefficient, the sum of said first coefficient, added to itself, and of said second coefficient is equal to 1, reduced in order to retain an equivalent level of the resultant signal.

8. The method according to claim 6,
wherein said stage of filtering and said stage of generating special effects, from the analysis, without carrying out the synthesis, comprise:
dividing the temporal value of the pitch by two, and
modifying the amplitudes of the original signal and of the two shifted signals.

9. The method according to claim 6,
wherein said stage of filtering and said stage of generating special effects, from the analysis, without carrying out the synthesis, comprise:
multiplying each sample of the original voice by a cosine varying at the rhythm of half of the fundamental (multiplication by two of the number of frequencies), or varying at the rhythm of one third of the fundamental (multiplication by three of the number of frequencies), and
adding the result obtained to the original voice.

10. The method according to claim 1,
wherein the method further comprises a stage of generating special effects associated with a synthesis.

11. The method according to claim 10,
wherein said stage of generating special effects associated with the synthesis comprises:
multiplying all the frequencies of the frequential components of the original signal, taken individually, by a coefficient, and
regenerating the moduli of the harmonics from the spectral envelope of said original signal.

12. The method according to claim 11,
wherein said multiplication coefficient of the frequential components is:
a coefficient dependent on the ratio between the new pitch and the real pitch, or
a coefficient varying, periodically or randomly, at low frequency.

13. A device for the carrying out of the method according to claim 1, comprising:
means for analysis making it possible to determine parameters representative of said sound signal, this means for analysis comprising:
means for calculating the envelope of the signal,
means for calculating the pitch and of its variation,
means for applying the inverse variation of the pitch to the temporal signal, consisting in performing a temporal sampling of the sound signal with a variable sampling step, this step varying with the inverse value of the pitch variation,
means for the Fast Fourier Transformation (FFT) of the preprocessed signal;
means for extracting the frequential components and their amplitudes from said signal, from the result of the Fast Fourier Transformation,
means for calculating the pitch in the frequential domain and its variation with respect to the previously calculated pitch in order to improve the precision of this previously calculated pitch.

14. The device according to claim 13,
further comprising at least one of:
means for synthesizing said representative parameters making it possible to reconstitute said sound signal, and/or
means for coding and of decoding said parameters representative of said sound signal,
means for filtering the noise and of generation of special effects, from the analysis, without passing through the synthesis, or
means for generating special effects associated with the synthesis.

15. The device according to claim 14,
wherein said means for synthesizing comprise:
means for summing sines of which the amplitude of the frequential components varies as a function of the envelope of the signal,
means for calculating of phases as a function of the frequencies value and of the values of phases and frequencies belonging to the preceding frame,
means for superimposing noise, and
means for applying the envelope.

16. The device according to claim 14,
wherein said means for filtering the noise and said means for generating special effects, from the analysis, without passing through the synthesis, comprise means for summing of the original signal, of the original signal shifted by one pitch in positive value and of the original signal shifted by one pitch in negative value.

17. The device according to claim 16,
wherein said shifted signals are multiplied by a same coefficient, and the original signal by a second coefficient, said sum of said first coefficient, added to itself, and of said second coefficient is equal to 1, reduced in order to retain an equivalent level of the resultant signal.

18. The device according to claim 14,
wherein said means for filtering and said means for generating special effects, from the analysis, without passing through the synthesis, comprise:
means for dividing the temporal value of the pitch by two, and
means for modifying the amplitudes of the original signal and of the two shifted signals.

19. The device according to claim 14, wherein said means for filtering and said means for generating special effects, from the analysis, without passing through the synthesis, comprise:

means for multiplying each sample of the original voice by a cosine varying at the rhythm of half of the fundamental (multiplication by two of the number of frequencies), or varying at the rhythm of one third of the fundamental (multiplication by three of the number of frequencies), and means for then adding the result obtained to the original voice.

20. The device according to claim 14, wherein said means for generating special effects associated with the synthesis, comprise:

means for multiplying all the frequencies of the frequential components of the original signal, taken individually, by a coefficient, and means for regenerating the moduli of the harmonics from the spectral envelope of said original signal.

21. The device according to claim 20, wherein said multiplication coefficient of the frequential components is:

a coefficient dependent on the ratio between the new pitch and the real pitch, or a coefficient varying, periodically, at low frequency.

* * * * *